US008668630B2

(12) United States Patent
Towley, III et al.

(10) Patent No.: US 8,668,630 B2
(45) Date of Patent: Mar. 11, 2014

(54) ADD-ON WEIGHT KIT FOR A SELECTORIZED DUMBBELL

(75) Inventors: Carl K. Towley, III, Alexandria, MN (US); Gregory S. Olson, Owatonna, MN (US)

(73) Assignee: PowerBlock Holdings, Inc., Owatonna, MN (US)

( * ) Notice: Subject to any disclaimer, the term of this patent is extended or adjusted under 35 U.S.C. 154(b) by 305 days.

(21) Appl. No.: 13/086,311

(22) Filed: Apr. 13, 2011

(65) Prior Publication Data

US 2012/0264575 A1 Oct. 18, 2012

(51) Int. Cl.
*A63B 21/00* (2006.01)

(52) U.S. Cl.
USPC ..... 482/93; 482/104; 482/105; 482/106; 482/108

(58) Field of Classification Search
USPC ..... 482/93, 910, 104, 105, 106, 107, 108
See application file for complete search history.

(56) References Cited

U.S. PATENT DOCUMENTS

| | | | | |
|---|---|---|---|---|
| 4,566,690 | A | 1/1986 | Schook | |
| 4,768,780 | A | 9/1988 | Hayes | |
| 5,637,064 | A | 6/1997 | Olson et al. | |
| 5,769,762 | A | 6/1998 | Towley, III et al. | |
| 7,775,947 | B2 | 8/2010 | Towley, III et al. | |
| 7,850,581 | B2 * | 12/2010 | Towley et al. | 482/108 |
| 8,012,069 | B2 * | 9/2011 | Towley et al. | 482/108 |

* cited by examiner

*Primary Examiner* — Jerome w Donnelly
(74) *Attorney, Agent, or Firm* — James W. Miller

(57) ABSTRACT

An add-on weight kit for a selectorized dumbbell comprises a second set of nested weights that are similar in shape and structure to a first set of nested weights originally provided on the dumbbell. The second set of weights has a plurality of overlying rails that will underlie an array of similar rails carried on the first set of nested weights. The kit includes a second handle having vertically spaced openings with the second handle being used in place of a first handle originally provided on the dumbbell. The openings on the second handle are arranged relative to the rails on the second set of weights such that the same connecting pin as used on the dumbbell to couple the first set of weights to the first handle can be used to additionally couple a selected number of the add-on weights to the second handle.

5 Claims, 4 Drawing Sheets

PRIOR ART

PRIOR ART

ADD-ON WEIGHT KIT FOR A SELECTORIZED DUMBBELL

TECHNICAL FIELD

This invention relates to exercise equipment and, more particularly, to selectorized dumbbells having a plurality of nested weights, a handle, and a movable selector for coupling a desired number of weight plates to each end of the handle to enable easy adjustment of the exercise mass.

BACKGROUND OF THE INVENTION

U.S. Pat. No. 5,637,064 to Towley et al, which is assigned to the assignee of this invention, discloses an existing selectorized dumbbell that is known as the PowerBlock®. In this dumbbell, there are eight nested weights each of which comprises a left weight plate and a right weight plate that are joined together by a pair of front and rear rails. The left and right weight plates of the nested weights are disposed in left and right weight plate stacks that are spaced apart from one another by the length of the front and rear rails. The rails of successive nested weights are longer and lower than the rails of the weight immediately to the inside to allow the weights to be nested together in the aforementioned manner.

The selectorized dumbbell disclosed in the 064 patent includes a handle that is dropped down into the gap between the left and right weight plate stacks. Each end of the handle includes a plurality of slots that are located such that one slot is below each of the rails. A selector comprising a U-shaped connecting pin having a pair of spaced, parallel connecting prongs is provided with the prongs of the connecting pin being insertable into the slots beneath the rails of one of the nested weights. When the user then lifts the handle, the handle will carry with it the all of the nested weights whose rails lie above the rail of the selected weight. Thus, the user can easily adjust the total weight carried by the handle, to adjust the exercise mass of the dumbbell, simply by repositioning the connecting pin from one set of slots to another.

A selectorized dumbbell of the type noted above can be adjusted from a minimum weight to a maximum weight. Some users might never progress beyond the maximum weight provided by the dumbbell. However, other users might reach the point where the maximum weight provided by the dumbbell is no longer enough for their exercise needs—their strength has improved so much that they have outgrown the dumbbell they originally purchased. While such a user could then purchase a larger and heavier dumbbell having a higher maximum weight, and manufacturers of such dumbbells would typically offer a few different dumbbells of different sizes for this purpose, the originally purchased dumbbell effectively becomes redundant or unnecessary. In this scenario, the user has obviously had to pay twice to purchase two different dumbbells.

To address this problem, the manufacturer of the PowerBlock® selectorized dumbbell has marketed a kit of add-on weights to allow the user to incrementally add further weight to the originally purchased dumbbell when the maximum weight of that dumbbell is now too light for the user's needs. Such a kit is disclosed in U.S. Pat. No. 5,769,762 which is also owned by the assignee of this invention.

The add-on weights of the 762 patent have a significantly different construction from the weights in the base dumbbell shown in the 064 patent. The add-on weights of the 762 patent still have spaced left and right weight plates, but such weight plates are no longer joined together by a pair of front and rear rails. Instead, the left and right weight plates are joined together by a bottom channel having front and rear walls with the front and rear walls of the various weights in the add-on kit horizontally overlying one another when the weights in the add-on kit are nested together. Various unique sets of holes and slots are placed in the front and rear walls of the channels. A second connecting pin is then inserted through one selected set of such holes and slots to additionally attach a desired number of the add-on weights of the 762 patent to the handle of the dumbbell. The number of such add-on weights that are attached change depending upon which set of holes and slots receives the second connecting pin.

While the 762 patent discloses an effective way of adding more weight to an existing, previously purchased dumbbell, it does require the user to manipulate and position two separate connecting pins, namely the U-shaped connecting pin provided with the dumbbell and the second, single pronged connecting pin provided with the kit of add-on weights. Moreover, each of these connecting pins employs a different pinning technique. The U-shaped connecting pin simply slides into one set of a series of vertically spaced sets of slots provided in the handle to position the connecting pin beneath the side rails of a selected weight in the series of nested weights. On the other hand, the single pronged connecting pin has to be inserted into one set of a series of horizontally spaced sets of holes and slots provided in the bottom channels of the weights themselves. This difference in pinning techniques is potentially confusing, particularly to a relatively new user of the dumbbell.

SUMMARY OF THE INVENTION

One aspect of this invention relates to an add-on weight kit for a selectorized dumbbell. The weight kit has a first set of a plurality of nested weights that include a plurality of horizontal rails that overlie one another in at least one vertically extending rail array, a first handle having an array of vertically spaced openings that are aligned with spaces below the rails in the rail array, and a selector comprising a connecting pin that includes at least one connecting prong that is horizontally insertable into one of the vertically spaced openings on the handle to slide below the rail of a selected weight to thereby couple the selected weight and all other weights whose rails lie above the rail of the selected weight to the handle. The add-on weight kit comprises a second set of a plurality of nested weights that include a plurality of horizontal rails that overlie one another with the rails of the second set being arranged to underlie the rails of the first set to form a downward continuation of the rail array of the first set when the first and second sets of weights are used together. The kit also includes a second handle that is taller than the first handle. The second handle has a bottom portion that includes a plurality of vertically spaced openings that are aligned with spaces below the rails of the second set of weights for reception of the connecting prong in the same manner as the connecting prong is received in the openings on the first handle. The second handle is used in place of the first handle when the first and second sets of weights are used together such that reception of the connecting prong below the rail of a selected weight in the second set of weights will couple the selected weight in the second set, all other weights in the second set whose rails lie above the rail of the selected weight in the second set, and all of the weights of the first set to the handle to thereby allow the total weight of the dumbbell to exceed what would have been obtainable from the first set of weights alone.

BRIEF DESCRIPTION OF THE DRAWINGS

This invention will be described more completely in the following Detailed Description, when taken in conjunction with the following drawings, in which like reference numerals refer to like elements throughout.

DETAILED DESCRIPTION

Figure 1:
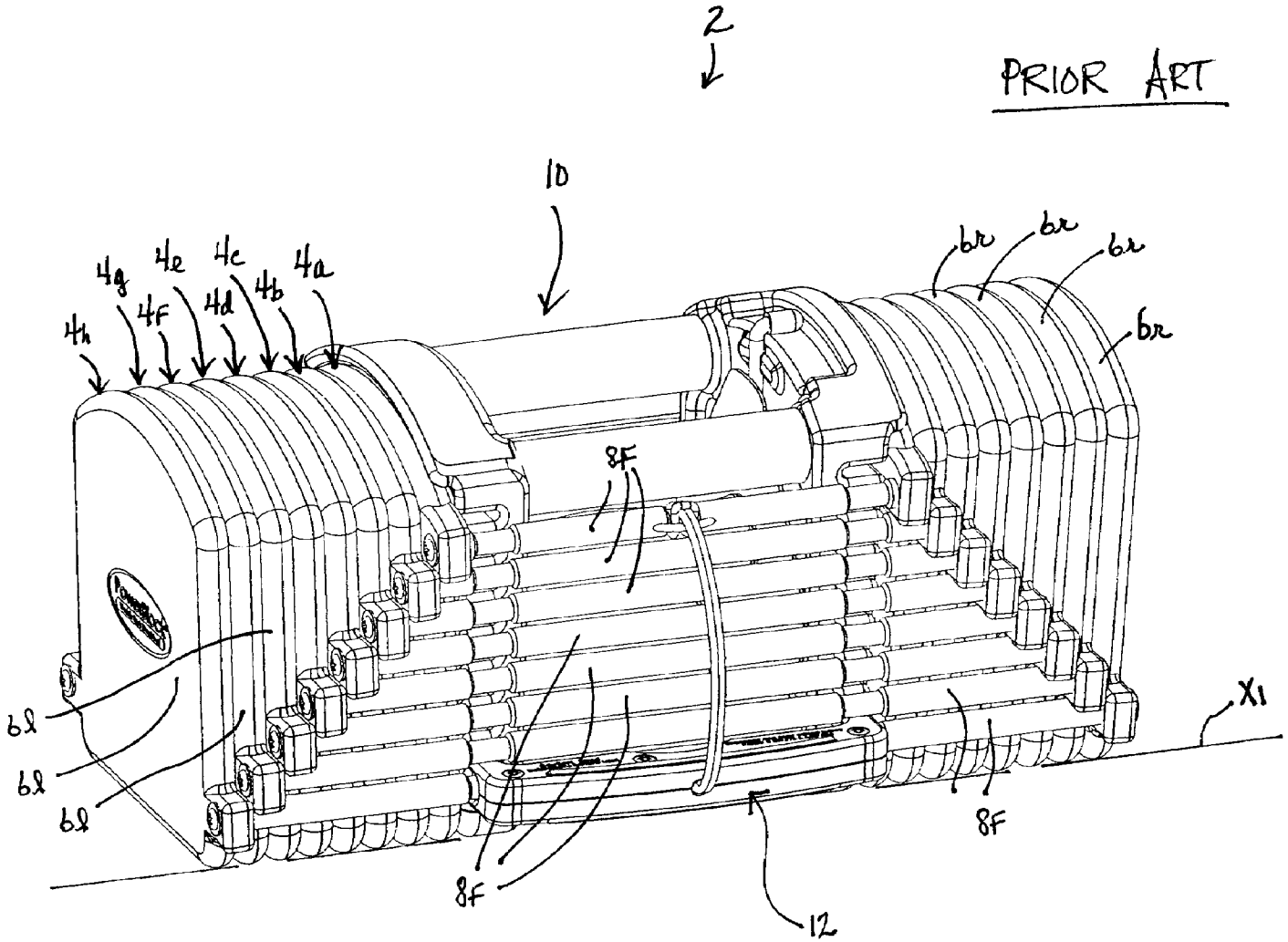
FIG. 1 is a perspective view of a prior art selectorized dumbbell.
Figure 2:
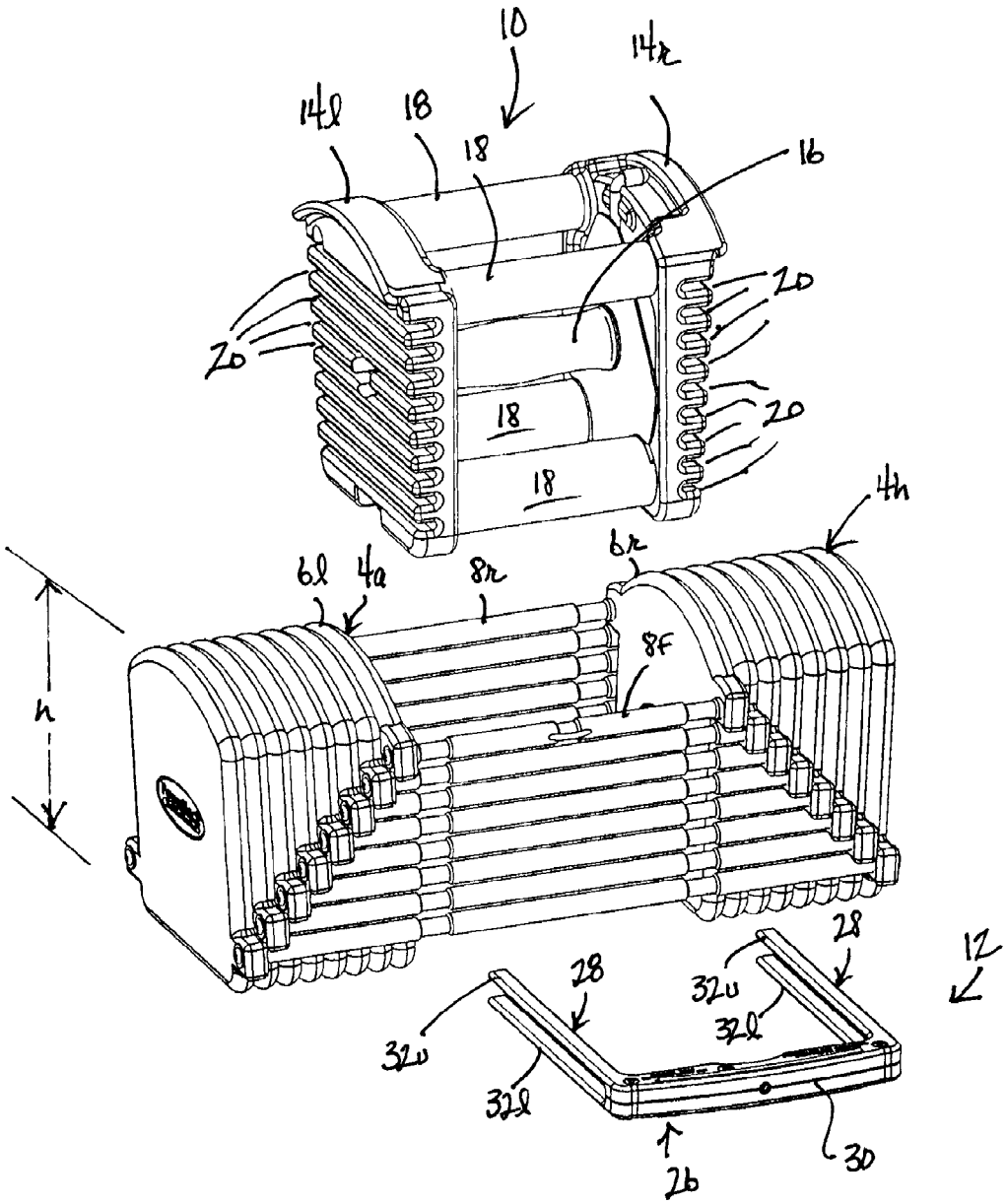
FIG. 2 is a perspective view of the prior art selectorized dumbbell of FIG. 1, particularly illustrating the handle, nested weights and selector thereof in exploded form.

A selectorized dumbbell known in the prior art is indicated generally as 2 in FIGS. 1 and 2. Dumbbell 2 is of the type disclosed in U.S. Pat. Nos. 5,637,064 and 7,775,947, which are hereby incorporated by reference. See in particular the dumbbell disclosed in FIGS. 6-12 of the 947 patent and the accompanying description thereto. While such patents may be referred to for a complete description of dumbbell 2, a review of the basic components of dumbbell 2 is in order herein.

Referring first to FIG. 2, dumbbell 2 comprises eight nested weights 4*a*-4*h*, a handle 10, and a selector 12. Each nested weight 4 comprises a left weight plate 61 and a right weight plate 6*r* that are joined together in a laterally spaced apart orientation by a front rail 8*f* and a rear rail 8*r* that connect weight plates 6*l* and 6*r* together. Beginning with the innermost weight 4*a* and working one's ways to the outermost weight 4*h*, rails 8 get progressively longer and connect to the weight plates 6 at progressively lower vertical elevations to allow weights 4 to nest together with left weight plates 61 being adjacent to one another in a left stack and right weight plates 6*r* being adjacent to one another in a right stack. Thus, front rails 8*f* and rear rails 8*r* are each arranged in a truncated pyramidal shaped array on the front and back sides, respectively, of dumbbell 2.

Handle 10 has a left end 141 and a right end 14*r* that are joined together in a laterally spaced apart orientation by a central hand grip 16 and a plurality of cross tubes 18. Each handle end 14 has a vertical array of slots 20 that are identically positioned on each handle end 14. In each array of slots 20, one slot 20 is positioned to be aligned with a gap 22 formed between vertically adjacent rails 8 by reduced diameter sections 24 of rails 8. Gap 22 provides access to slot 20 for the reception of a portion of selector 12. In addition, each array of slots 20 has one slot 20 provided above the reduced diameter sections 24 of rails 8 of innermost weight 4*a*. Thus, while there are eight weights 4 that form arrays of eight front and rear rails 8, there are nine slots 20 in each end 14 of handle 10.

Selector 12 is a U-shaped connecting pin 26 having a pair of laterally spaced apart connecting prongs 28 connected to a base 30. Each connecting prong 28 has overlying upper and lower forks 32*u* and 321. Forks 32*u* and 321 of prongs 28 are designed to straddle the reduced diameter sections 24 of the front rail 8*f* of a selected weight to slide into the sets of slots 20 that are immediately below and above such reduced diameter sections 24. Prongs 28 will pass through the length of slots 20 until the free ends thereof come out the other side and straddle the reduced diameter sections 24 of the rear rail 8*r* of the selected weight. FIG. 1 shows connecting pin 26 having been inserted into handle 10 such that it straddles the rails 8 of outermost weight 4*h*.

Preferably, the double forks 32 of each connecting prong 28 are flexible for the shock absorption reasons set forth in the 947 patent, which has been incorporated by reference herein. However, such flexibility as well as the double fork construction of each connecting prong 28 could be dispensed with in favor of the type of connecting pin shown in the 064 patent, namely a U-shaped connecting pin in which each connecting prong 28 is a single rigid member. With such a connecting pin, the uppermost slot 20 above the rails 8 of innermost weight 4*a* would not longer be needed in each end 14 of handle 10. Only eight slots 20 would be needed with each slot 20 being aligned with gap 22 beneath each rail 8.

The user can easily adjust the total weight or exercise mass of dumbbell 2 by inserting selector 10 into different locations on handle 10. In the position shown in FIG. 1, all eight weights 4*a*-4*h* will be coupled to handle 10 for use in performing an exercise since the rails 8 of nested weights 4 each abut with portions of the weight 4 immediately above one another. Thus, picking up rails 8 of a selected weight 4 in the array of nested weights 4*a*-4*h* will pick up the selected weight 4 and all the other weights 4 whose rails 8 lie above rails 8 of the selected weight 4. For example, if connecting pin 26 is inserted to straddle rails 8 of the fourth weight 4*d*, then the four weights 4*a*-4*d* will be coupled to handle 10 by connecting pin 26.

Weight plates 6 of nested weights 4 of dumbbell 2 all have a uniform height h relative to one another. The lower edges of weight plates 6 all terminate in a common plane indicated as x in FIG. 1. This is true regardless of how many nested weights 4 are coupled to handle 10. Thus, dumbbell 2 of the prior art has a consistent cross-sectional profile from front to back regardless of the total weight provided by dumbbell 2. The only change in dumbbell 2 as the total weight changes is the length of dumbbell 2. As the total weight of dumbbell 2 increases, dumbbell 2 simply gets progressively longer from side to side as more left and right weight plates 6*l* and 6*r* of more nested weights 4 are added to each end 14*l* and 14*r*, respectively, of handle 10.

Figure 3:
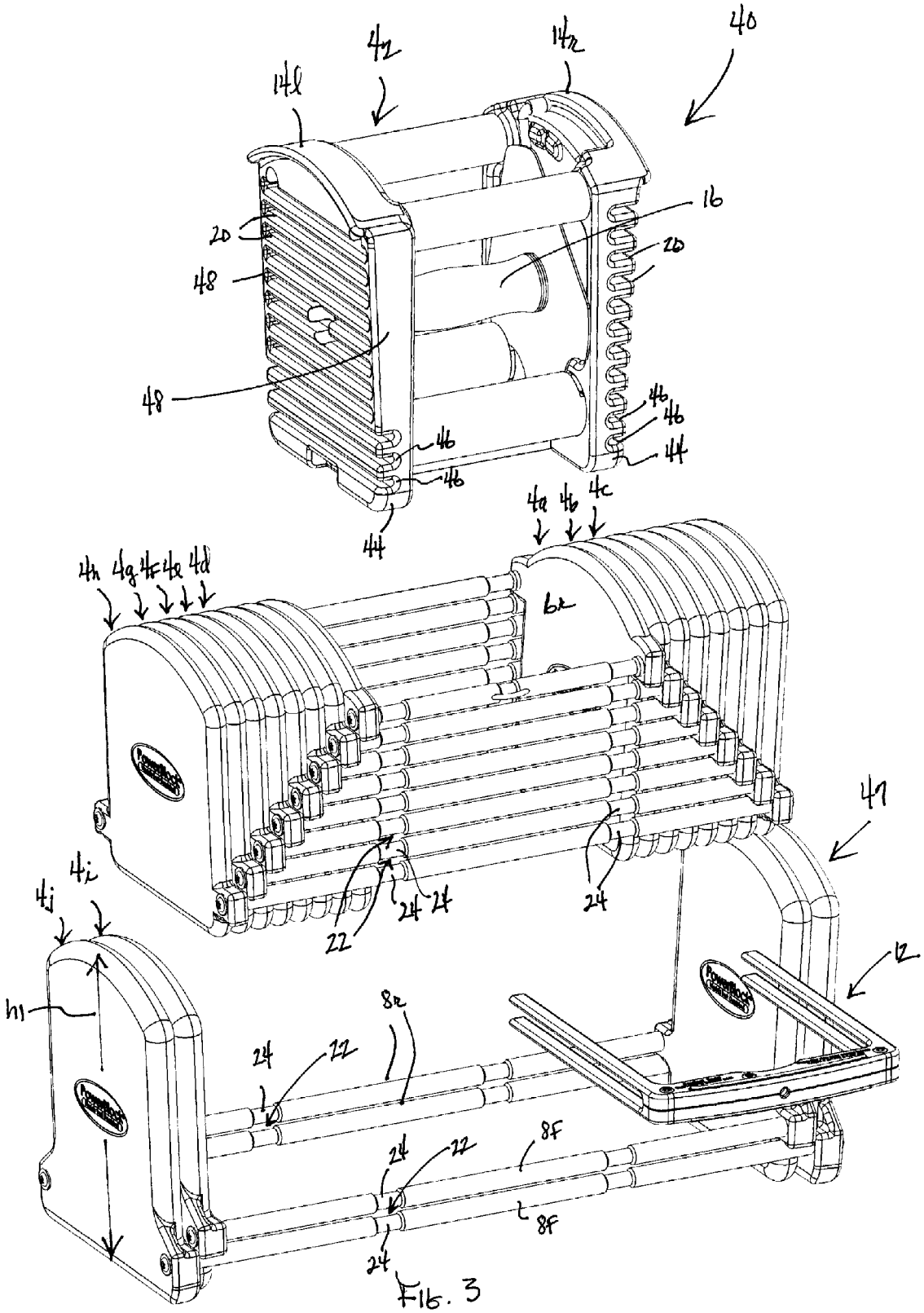
FIG. 3 is a perspective view of a set of nested add-on weights and a new handle that comprise an add-on weight kit according to this invention, particularly illustrating the add-on weight kit in an exploded form relative to the nested weights and selector of the dumbbell of FIG. 1 with which the add-on weight kit is used.
Figure 4:
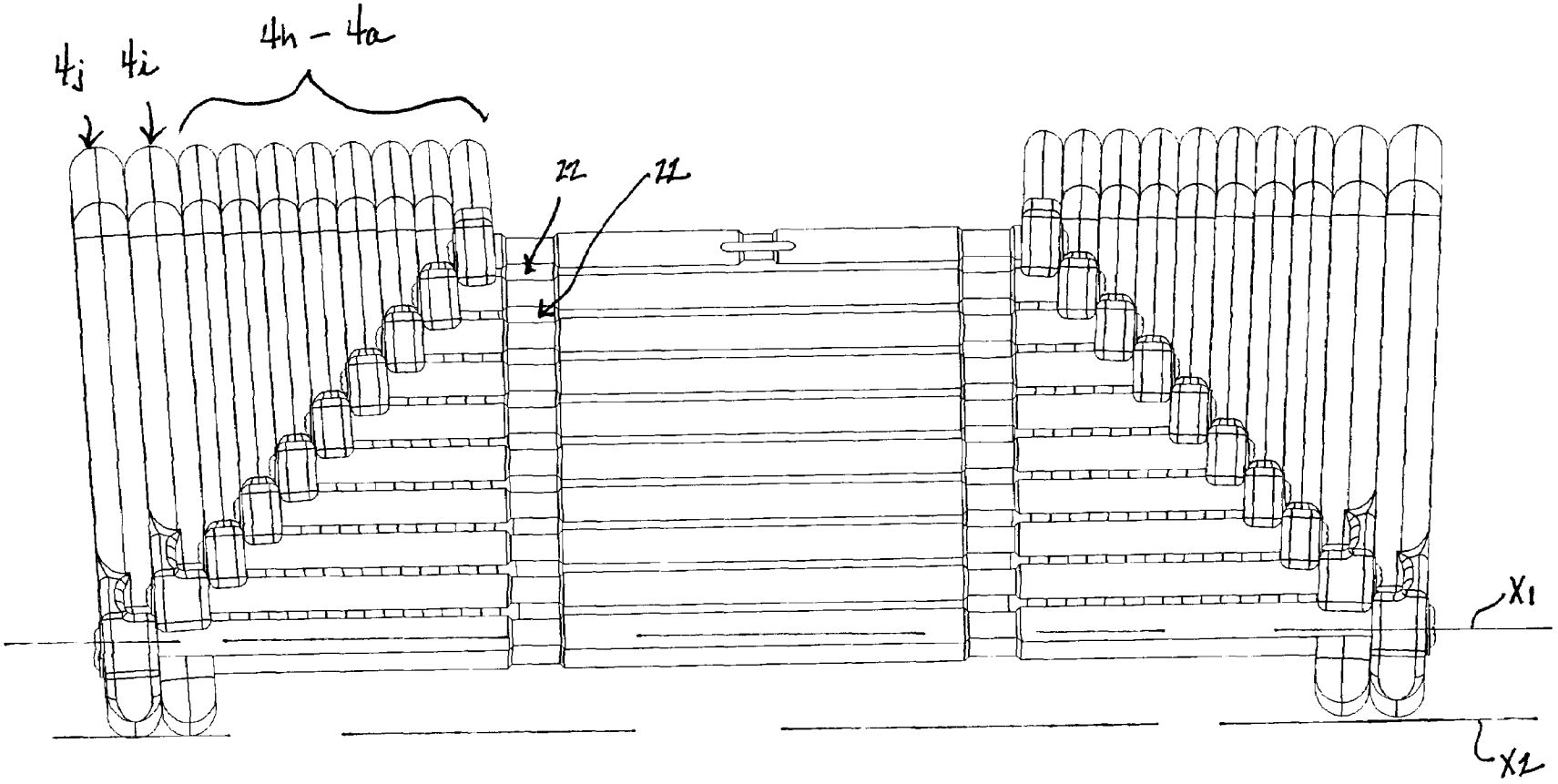
FIG. 4 is a side elevational view of the nested weights of the dumbbell of FIG. 1 being nested within the set of nested add-on weights of the add-on weight kit of FIG. 3.

Referring now to FIGS. 3 and 4, this invention relates to an add-on weight kit 40 for supplementing or extending the maximum total weight previously provided by dumbbell 2. Weight kit 40 is used with the nested weights 4 and selector 12 of dumbbell 2. However, handle 10 originally supplied with dumbbell is not used when weight kit 40 is used. Instead, a new handle 42 provided as part of weight kit 40 is used in place of handle 10.

Handle 42 that is part of weight kit 40 is in concept and structure similar to handle 10 such that the parts of handle 42 that are common to handle 10 will be referred to with the same reference numerals as used with respect to handle 10. The major difference is that the ends 14*l* and 14*r* of handle 42 have downwardly extending vertical extensions 44 that include two sets of additional slots 46. Slots 46 are identical to slots 20, but have essentially just been added to handle 42 beneath the previously existing slots 20 in the vertical extensions 44 of handle 42.

In addition to new handle 42, add-on weight kit 40 includes an additional set 47 of nested weights 4, i.e. a ninth nested weight 4*i* and a tenth nested weight 4*j*. Nested weights 4*i* and 4*j* are similar to nested weights 4*a* and 4*h*. For example, the left and right weight plates 6*l* and 6*r* of nested weights 4*i* and 4*j* have the same front to back width and the same rounded top as weight plates 6*l* and 6*r* of nested weights 4*a*-4*h*, but they have a taller height h1 as compared to their height h in nested weights 4*a*-4*h*. Because of this additional height h1, each nested weight 4*i* and 4*j* has more mass than each nested weight 4*a*-4*h* and accordingly provides an incrementally larger weight adjustment than each weight 4*a*-4*h*. The height h1 of all nested weights 4*i* and 4*j* in weight kit 40 is uniform relative to each other such the lower edges of weight plates 6 of nested weights 4*i* and 4*j* all terminate in a common plane x2 that is lower than the plane x1 that dumbbell 2 would have had if weight kit 40 had not been used.

In order to use weight kit 40, the user takes dumbbell 2 and removes handle 10 therefrom. The set of nested add-on weights 4*i* and 4*j* are placed on a support surface, such as the top of a support stand, and the nested weights 4*a*-4*h* are then dropped down into nested weights 4*i*-4*j* such that weights 4*a*-4*j* are now all nested together as a single unit. When so nested, the lower edges of nested weights 4*i*-4*j* will engage against the support surface while the lower edges of nested weights 4*a*-4*h* will actually be spaced up above the support surface, as shown in FIG. 4. The taller handle 42 that is part of weight kit 40 will then be dropped down into the gap between the stacks of left and right weight plates 6*l* and 6*r*.

Preferably, the nested weights 4*a*-4*h* would always reside within the nested add-on weights 4*i*-4*j* regardless of whether handle 10 or handle 42 is used. Keeping weights 4*a*-4*j* continually nested together minimizes clutter and saves significant time. The user need only exchange one handle 10 or 42 for the other and does not need to disturb or rearrange the set of nested weights 4*a*-4*j* at all once they are initially nested together. A support stand (not shown) can be sold having a support surface comprising an upwardly facing tray that is long enough to encompass and support thereon the total length of the complete set of nested weights 4*a*-4*j* from one to the other end thereof.

When handle 42 is in use within the complete set of nested weights 4*a*-4*j*, the same selector 12 in the form of U-shaped connecting pin 26 can now be used to select one or both of the add-on weights 4*i*-4*j*, which selection will necessarily carry with it all of the weights 4*a*-4*h*, for coupling to handle 42. All the user need do is to slide connecting pin 26 into a vertically adjacent pair of slots 20 and/or 46 such that prongs 28 of connecting pin 26 straddle the reduced diameter sections 24 of rails 8 of the selected weight 4*i*-4*j*.

This significantly enhances ease of use of dumbbell 2 and makes weight selection more intuitive. The need for two separate connecting pins is obviated. All the user need do is to use connecting pin 26 that is normally provided with dumbbell 2. Moreover, the pinning technique for all the weights 4, whether such weights 4*a*-4*h* are part of the original dumbbell 2 or part of weight kit 40, is the same, i.e. sliding prongs 28 into a pair of slots on each end of handle 42. The user need not remember or even know how to insert two different connecting pins into weights have different pinning techniques. There is now only a single connecting pin and a single pinning technique, greatly simplifying use and adjustment of dumbbell 2 with or without add-on weight kit 40.

Handle 42 is shown in FIG. 3 in a form in which it is used only to connect add-on weights 4*i* and 4*j* to handle 42. Enough slots 20 on left end 141 of handle 42 have been blocked off by blocking walls 48 so that connecting pin 26 can no longer be used to pin any of the original weights 4*a*-4*h* to handle 42. Of course, when such weights 4*a*-4*h* are nested within the set of add-on weights 4*i* and 4*j*, pinning weight 4*i* or both weights 4*i* and 4*j* to handle 42 will necessarily pick up and carry all the weights 4*a*-4*h* due to the abutting engagement between each rail 8 and the rail 8 immediately thereabove. With handle 42 as depicted in FIG. 3, if the user wishes to revert to exercise with a lighter weight provided only by some or all of the original weights 4*a*-4*h*, handle 42 would be removed and replaced with the originally provided handle 10.

The reason for making handle 42 usable only for direct pinning of add-on weights 4*i* and 4*j* is that handle 42 when used for direct pinning of some or all of weights 4*a*-4*h* ends up supporting such weights 4*a*-4*h* above the support surface engaged by the bottom of handle 42. The bottom of handle 42 is in the x2 plane while the weights 4*a*-4*h* have their lower edges in the higher x1 plane. If handle 42 is dropped or laid down hard when loaded in this manner, damage can occur to a connecting pin 26 having flexible connecting prongs 28 due to a shearing action that occurs between weights 4*a*-4*h* and connecting prongs 28.

However, if connecting pins 28 are rigid or are made from a strong enough flexible material, it would not be necessary to block off slots 20 on handle 42. In this case, blocking walls 48 would be removed and handle 42 would have slots 20 that are completely open all the way through each side 14*l* and 14*r* of handle 42. Any combination of the original weights 4*a*-4*h* as well as the add-on weights 4*i* and 4*j* could then be pinned by connecting pin 26 to handle 42 of add-on kit 40. In this case, the user might simply replace original handle 10 with handle 42 of add-on kit 40 and leave add-on kit 40 permanently in place within the dual sets of nested weights 4*a*-4*j* shown in FIG. 4. Even in this event, if the user were to retain original handle 10, he or she could always switch back and forth between handle 10 and handle 42 depending upon the user's preference. Some users might prefer the somewhat more vertically compact form of dumbbell 2 that results when the shorter original handle 10 is used if the user simply needs an amount of weight that is provided by some combination of the original weights 4*a*-4*h*.

Various modifications of this invention will be apparent to those skilled in the art. While the add-on weight kit 40 has been shown as comprising two additional add-on weights 4*i* and 4*j*, kit 40 could comprise more than two such weights 4*i* and 4*j* with the vertical extensions 44 and the numbers of slots 46 on each end of handle 42 being increased accordingly. However, regardless of the number of weights 4 in add-on kit 40, all of the weights 4 in the add-on kit will have the same uniform height h1 relative to one another such that their lower edges align on a common plane x2 that is lower than plane x1 of base dumbbell 2. Weight plates 6 of weights 4 in add-on kit 40 could also be thicker than weight plates 6 of weights 4 in dumbbell 2 in addition to being taller as shown in FIG. 4, or could have a thickness that is the same as weight plates 6 of weights 4 in dumbbell 2.

Accordingly, the scope of this invention is to be limited only by the appended claims.

The invention claimed is:

1. An add-on weight kit for a selectorized dumbbell having a first set of a plurality of nested weights that include a plurality of horizontal rails that overlie one another in at least one vertically extending rail array, a first handle having an array of vertically spaced openings that are aligned with spaces below the rails in the rail array, and a selector comprising a connecting pin that includes at least one connecting prong that is horizontally insertable into one of the vertically spaced openings on the handle to slide below the rail of a selected weight to thereby couple the selected weight and all other weights whose rails lie above the rail of the selected weight to the handle, wherein the add-on weight kit comprises:

(a) a second set of a plurality of nested weights that include a plurality of horizontal rails that overlie one another with the rails of the second set being arranged to underlie the rails of the first set to form a downward continuation of the rail array of the first set when the first and second sets of weights are used together;

(b) a second handle that is physically separate and distinct from the first handle, that is taller than the first handle, and that can be alternatively used in place of the first handle only by removing the first handle from the selectorized dumbbell and by inserting the second handle into the selectorized dumbbell in place of the first handle, wherein the second handle has a bottom portion that includes a plurality of vertically spaced openings that are aligned with spaces below the rails of the second set of weights for reception of the connecting prong in the same manner as the connecting prong is received in the openings on the first handle, wherein the second handle is used in place of the first handle when the first and second sets of weights are used together such that reception of the connecting prong below the rail of a selected weight in the second set of weights will couple the selected weight in the second set, all other weights in the second set whose rails lie above the rail of the selected weight in the second set, and all of the weights of the first set to the handle to thereby allow the total weight of the dumbbell to exceed what would have been obtainable from the first set of weights alone; and (c) wherein the weights of the first set of weights have a first uniform height relative to one another, wherein the weights of the second set of weights have a second uniform height relative to one another with the second uniform height being greater than the first uniform height such that the weights of the second set of weights will rest on a horizontal support surface while the weights of the first set of weights will be elevated above the support surface when the second handle is coupled to the first set of weights and at least one of the weights of the second set and the dumbbell is laid down on the support surface.

2. The add-on weight kit of claim 1, wherein the vertically spaced openings on the second handle permit reception of the connecting prong of the connecting pin only for directly coupling the weights of the second set of weights to the handle with the first set of weights being indirectly coupled to the handle only by the overlying relationship of the rails of the first set of weights relative to the rails of the second set of weights, whereby use of the first set of weights without use of the second set of weights requires that the first handle be used in place of the second handle.

3. The add-on weight kit of claim 2, wherein the connecting prong of the connecting pin is flexible.

4. The add-on weight kit of claim 1, wherein the second handle contains the same vertically spaced openings that are present on the first handle with the vertically spaced openings on the bottom portion of the second handle forming a downward continuation of the openings that are present on the first handle, and wherein the connecting prong of the connecting pin can be received in any of the openings on the second handle to permit the second handle to be used with the first set of weights even when the second set of weights is not being used therewith.

5. The add-on weight kit of claim 1, wherein the rail array on the first set of weights has a truncated pyramidal shape as one proceeds from top to bottom in the rail array, and wherein the rails of the second set of weights continue the pyramidal shape of the rail array downwardly when the first and second sets of weights are used together.

* * * * *